US005586089A

United States Patent [19]

McGarvey

[11] Patent Number: 5,586,089

[45] Date of Patent: Dec. 17, 1996

[54] ROTATIONAL MOIRE TIMEPIECE

[76] Inventor: John D. McGarvey, 21-65 38th St., Astoria, N.Y. 11105

[21] Appl. No.: 210,625

[22] Filed: Mar. 18, 1994

[51] Int. Cl.[6] ..... G04B 19/00; G04B 19/06

[52] U.S. Cl. ..... 368/223; 368/233

[58] Field of Search ..... 368/223–239

[56] References Cited

U.S. PATENT DOCUMENTS

| | | | |
|---|---|---|---|
| 2,891,338 | 6/1959 | Palamara | 40/132 |
| 3,595,009 | 7/1971 | Pakter | 58/126 A |
| 3,803,831 | 4/1974 | Horzick | 58/126 R |
| 3,811,213 | 5/1974 | Eaves | 40/106.53 |
| 4,090,351 | 5/1978 | Foreman, Jr. | 368/185 |
| 4,274,154 | 6/1981 | Dostoomian et al. | 368/220 |
| 4,279,031 | 7/1981 | Dostoomian | 368/82 |
| 4,357,691 | 11/1982 | Goodchild | 368/62 |
| 4,789,573 | 12/1988 | Jenkinson | 428/28 |
| 4,885,193 | 12/1989 | Head | 428/14 |
| 4,976,620 | 12/1990 | Jacquard et al. | 434/81 |

FOREIGN PATENT DOCUMENTS

| | | |
|---|---|---|
| 1127795 | 7/1955 | France . |
| 1259766 | 6/1960 | France . |
| 328501 | 4/1958 | Switzerland . |
| 757036 | 9/1956 | United Kingdom . |
| 772228 | 4/1957 | United Kingdom . |

*Primary Examiner*—Bernard Roskoski

[57] ABSTRACT

A timepiece having a plurality of plates (12, 14, 16) in place of the standard hour, minute and second's hands, printed with patterns of open and opaque areas (52). As these plates rotate, novel and stimulating visual effects in the form of multiple moiré images (54) are produced. Optional internal illumination (38) enhances the moiré images. Some patterns consist primarily of a series of angular linear shapes, that have an alternating sequence of approximately.

360°/N=Y and L+Y=X, where N represents the desired number of concentric ring segments, which may be any integer, Y represents the resulting rotation angle, L represents the selected initial angled line pattern which may be any angle from 0° to 360° and X represents a rotated angled line pattern for a contiguous segment, this contiguous segment is located counter-clockwise contiguously to the selected segment. The rotation angle Y is subsequently added to the rotated angled line pattern X and then sequentially to all the remaining contiguous counter-clockwise line angle patterns.

11 Claims, 4 Drawing Sheets

ROTATIONAL MOIRE TIMEPIECE

BACKGROUND

1. Field of the Invention

This invention relates to apparatus for chronographic display and in particular to a clock or a watch in which multiple patterns rotate in correspondence to the passage of time, producing various animated moiré images.

2. Discussion of Prior Art

There are numerous prior art timepieces that use one or more partially transparent or translucent discs or plates in place of one or more of the standard linear hands to create visual effects. While some of these effects are pleasant or amusing to view, the lack of quantity and variety of effects, as well as certain effects that produce uncomfortable visual stimulus, results in a display that becomes uninteresting after a short time. This is due in large part to the inherent limitations of each device or design. Some of the prior art timepieces use a pair of polarized plates such as in French patent 1,127,795, to INVICTA, (Société Anonyme) 1956, Dec. 24, which when rotated, create a cancellation effect that blocks reflected light twice per rotation, causing a vibrant flashing effect. Timepieces that use plates printed with translucent sections of color can produce pleasant color blending effects when rotated, especially if color gradients are used, as in U.S. Pat. No. 3,803,831, to Joseph Horzick, 1974, Apr. 16. However, these effects are very subtle and if used exclusively, tend to be only mildly stimulating. Much of the prior art in the field falls into the category of plates with decorative designs, which are usually figurative shapes, as in an airplane that rotates around the dial, or ornamental shapes. For example, U.K. patent 757,036, to Ernest Bornel, 1956, Sep. 12, shows a timepiece with a pair of plates having a sinusoidal line pattern, similar in shape to the spokes of a decorative wagon wheel. One of the plates is printed in a mirror image or mounted in reverse for contrast. These reversed decorative shapes when rotated, produce an unchanging, constant movement effect. In another embodiment, Bornel also uses plates printed with large geometric shapes that alternately hide and reveal similar geometric shapes. While these combined figures can be visually interesting because of their shapes, the optical effects that are produced are minimal.

Another area of chronographic display is in the area of lenticular optics, which are small optical lenses embossed on a surface. One or more overlapped lenticular plates when rotated, will produce a wavy, distorted image. This is achieved by the refractive lens-like structure of the material. While this can create a variety of patterns, especially if there is a graphic image underneath the lenticular plates, it is generally unpleasant to view, except briefly. This is due to the innate blurry, out of focus nature of the optics. Complexity in manufacturing and higher material cost adds to the drawbacks in the use of this media.

OBJECTS AND ADVANTAGES

It is an object of this invention to provide a timepiece that exhibits novel, complex and pleasantly stimulating visual effects.

It is a further object to provide these effects in a device that can be inexpensively manufactured using existing standard materials and standard manufacturing processes.

It is a further object to provide a timepiece that produces an immediately understood visual indication of the current time.

It is another object of the present invention to provide optional internal illumination to be used as visual enhancement for the moiré pattern designs.

Still further objects and advantages will become apparent from a consideration of the ensuing description and drawings.

Figure 2:
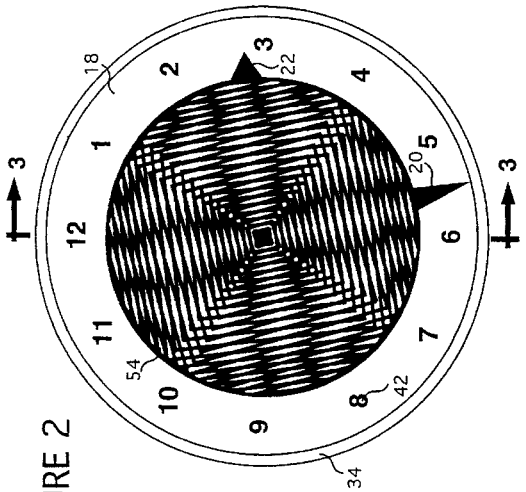
FIG. 2, is a front view of the device with pattern 54 shown printed on all three plates, with the second's and minute plate shown in alignment and the hour plate out of alignment.

| Reference Numerals In Drawings | |
|---|---|
| 12 seconds indicator plate | 14 minute indicator plate |
| 16 hour indicator plate | 18 background plate |
| 20 minute indicator point | 22 hour indicator point |
| 24 clock motor | 26 seconds drive shaft |
| 28 minute drive shaft | 30 hour drive shaft |
| 32 transparent cover bezel | 34 clock housing |
| 36 backing plate | 38 circular fluorescent lamp |
| 40 lamp power supply | |
| 44 motor mounting sleeve | 42 time reference numbers |
| 48 minute mounting sleeve | 46 hour shaft mounting sleeve |
| 52 concentric square pattern | |
| 56 right angle pattern | 50 wall mounting hole |
| 60 small component pattern | 54 pattern composite image |
| 64 concentric circle pattern | 58 pattern composite image |
| 68 multi-segment pattern | 62 pattern composite image |
| 72 second inner ring | 66 pattern composite image |
| 76 fourth inner ring | 70 outer ring |
| 80 next segment of ring 70 | 74 third inner ring |
| 84 pattern composite image | 78 upper segment of ring 70 |
| 88 pattern composite image | 82 pattern composite image |
| 92 geometric squares pattern | 86 pattern composite image |
| 96 geometric triangle pattern | 90 pattern composite image |
| 100 offset circle pattern | 94 pattern composite image |
| | 98 pattern composite image |
| | 102 pattern composite image |

DETAILED DESCRIPTION OF THE PREFERRED EXEMPLARY EMBODIMENTS

Figure 1:
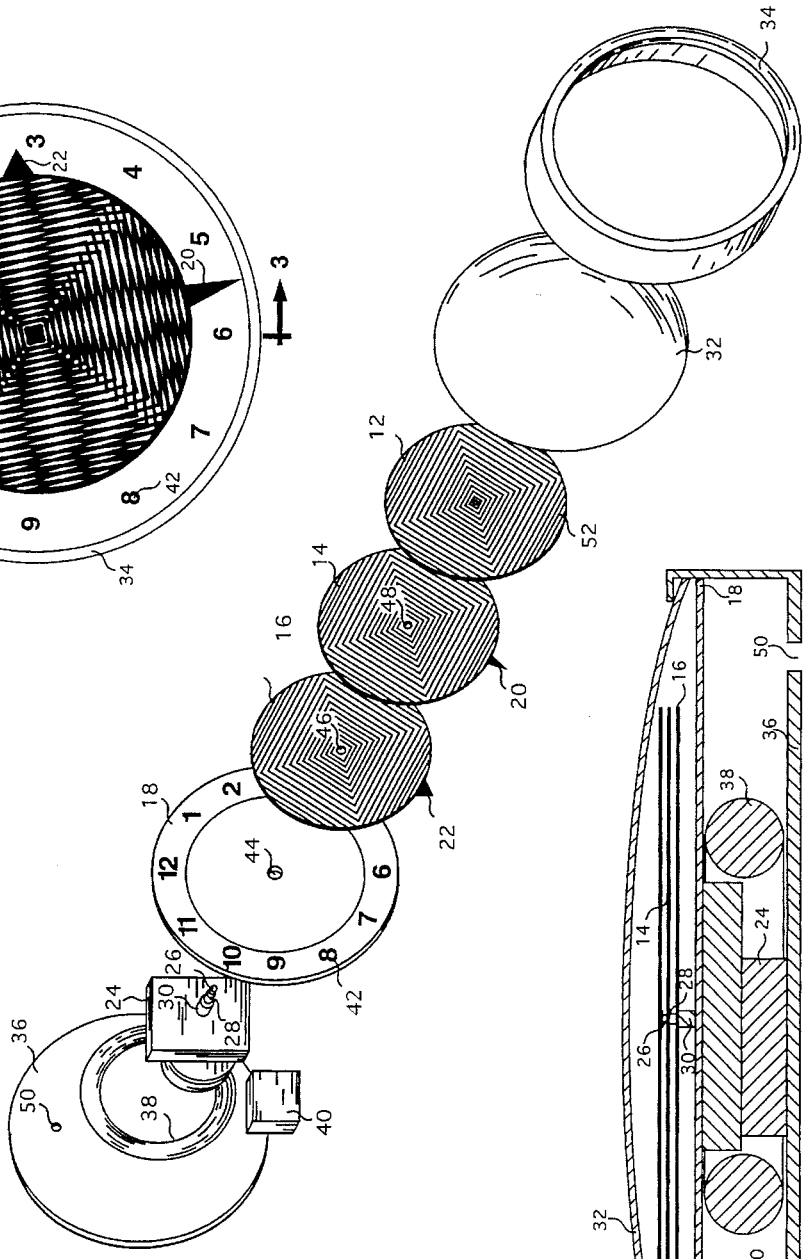
FIG. 1, is an exploded perspective view of the device in the embodiment of a wall clock.
Figure 3:
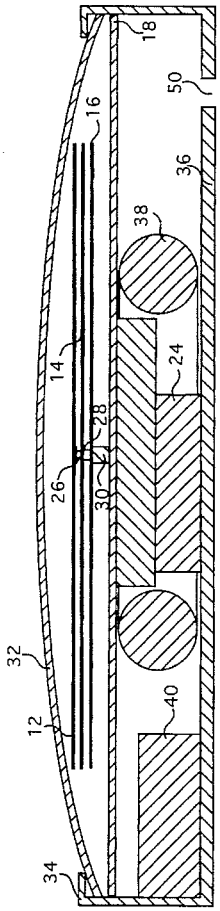
FIG. 3, is a section (3—3) through the center of the device.

As shown in FIGS. 1–3, the invention is shown in the form of a conventional wall clock, however the invention applies to all timepieces that use rotational time indicator discs or plates, including but not limited to, wrist watches, billboard clocks, table clocks and alarm clocks. This is because the invention functions the same regardless of scale or rotational drive mechanisms. For example, the moiré pattern plates may be rotated by peripheral gears or central shafts or a combination of the two.

Referring again to FIGS. 1–3, rotational movement occurs initially from a clock motor 24, which rotates an hour drive shaft 30, a minute drive shaft 28 and a second's drive shaft 26. These shafts rotate at standard clock speeds. While a greater or lesser number of pattern plates may be used, for ease of illustration, three moiré pattern plates are shown, a second's plate 12 that is flush mounted to shaft 26, a minute's plate 14 that is mounted to shaft 28 by a minute mounting sleeve 48, and an hour plate 16, which is attached to shaft 30 by an hour mounting sleeve 46. For numerical or graphic time reference, a stationary background plate 18 is mounted to motor 24 by a motor mounting sleeve 44. A housing 34, along with a backing plate 36 and a glass or plastic transparent cover or bezel 32 contains and protects the plates and motor. The entire clock can be attached to a flat surface by a wall mounting hole 50.

By way of explanation, the moiré effect is produced by transparently superposing two or more patterns composed of one or more groups of alternating open and non-open or opaque areas. When these patterns are shifted in and out of registration or alignment, light interference or cancellation patterns are formed, which produces an optical illusion or virtual image of new shapes or patterns. When the individual supervised designs are displaced even slightly, the composite image changes considerably. Production of a composite moiré image requires a sufficient quantity of open and opaque areas, as well as generally equidistant spacing of these areas.

Moiré patterns exhibit different characteristics depending on the type of movement of the patterns. For example, two or more transparent plates having a pattern design consisting exclusively of equidistant axially centered concentric circles, with the largest circle on the outside perimeter and the smallest circle in the center, when transparently superposed and rotated around its center axis will not produce any visual effect. However, if these plates are moved reciprocally off center, stunning moiré cancellation patterns are produced. A similar situation exists with radial line designs. Plates with pattern designs composed exclusively of either converging or diverging radial lines, when rotated with the radial center point being the center of rotation, produce a flashing, scintillating image. While this image can be very eye catching, it lacks variety in image and rhythm, since only a single image is produced. However when the radial center points are displaced from either each other or the center of rotation or the designs are moved reciprocally, a composite image of alternating conical shapes is produced.

This invention uses moiré pattern design displacement in the form of rotation, to produce composite images. The effects and images produced are dependent on pattern design and speed of rotation. With certain moiré pattern designs, cancellation patterns can produce cycles of multiple, changing, moving or otherwise animated images. The effect of illusion of motion, in which virtual images that move at various speeds or even appear to change speeds during a cycle of an effect is one example. Specific types of moiré pattern composites possess unique visual properties, such as inverse imaging, component magnification and separate composite shape production.

Figure 4:
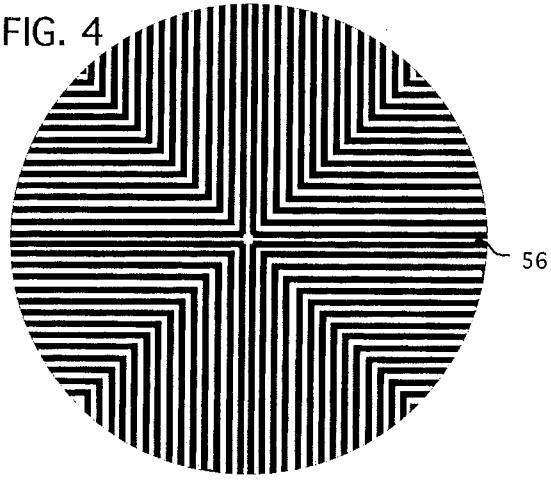
FIG. 4, shows a moiré clock pattern composed of right angle lines arranged in concentric quadrants.
Figure 5:
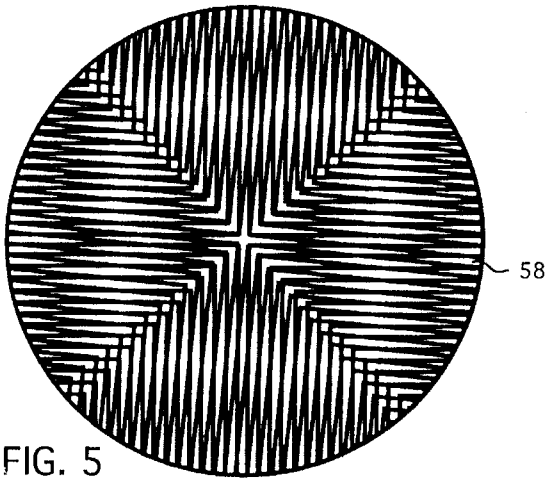
FIG. 5, shows the pattern as seen in FIG. 4 combined with itself and rotated out of alignment to form a composite image.

As a general rule, linear geometric designs tend to produce reciprocal or inverse geometric animation effects. For example, a pattern design composed of concentric squares 52, as shown in FIG. 1, transparently combined with itself, will produce a composite image of a pair of intersecting lines 54, as shown in FIG. 2. When continuously rotated, composite image 54 will appear to expand and contract. The inverse of this is also true, as shown in FIG. 4, a pattern design composed of right angle lines grouped in a concentric quadrant pattern 56 when superposed onto itself will produce a composite image of expanding and contracting squares 58, as shown in FIG. 5.

Figure 6:
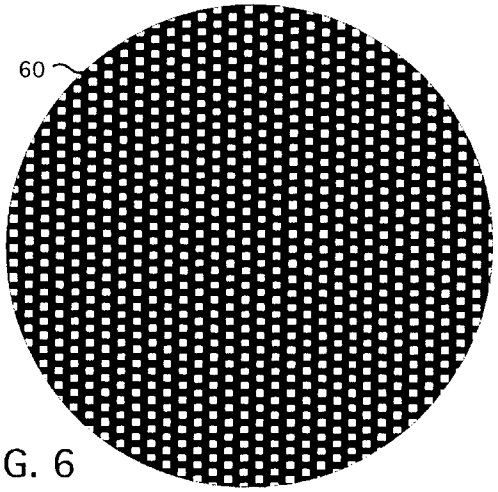
FIG. 6, is an example a moiré clock pattern consisting of small squares that are grouped equidistantly in staggered rows.
Figure 7:
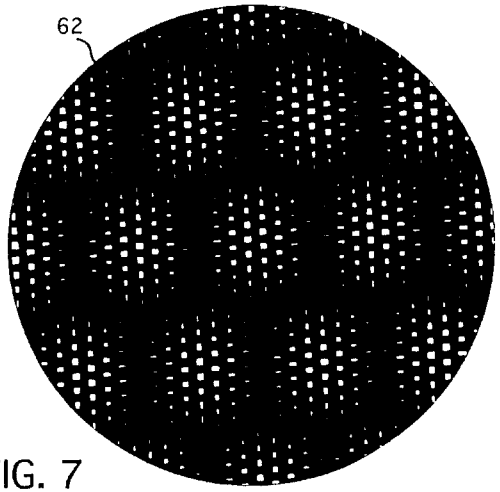
FIG. 7, shows the pattern as seen in FIG. 6 combined with itself and rotated out of alignment to form a composite image.

Designs composed of small components generally produce a component magnification effect. For example, FIG. 6 shows a pattern design 60 consisting of small squares that are grouped equidistantly in staggered rows. When combined with itself and rotated seven degrees as shown in FIG. 7, cancellation patterns are formed which produce a composite image 62 of the staggered rows of squares magnified and rotated 90°. When the design is continuously rotated, one of the animation effects is that of the smallest components of the design, the squares, will appear to rhythmically expand and contract. In other words, the squares appear to be cyclically magnified and reduced. This effect operates virtually independently of the size of the component moiré squares, dots, stars, triangles or some other shape, provided there is sufficient quantity of components to produce cancellation patterns. Composite moiré images may be formed from component shapes as small or smaller than 0.3 millimeters, to as large as desired. Component size and spacing selection is based on what is visually appropriate for each moiré pattern plate and the effects desired.

Figure 8:
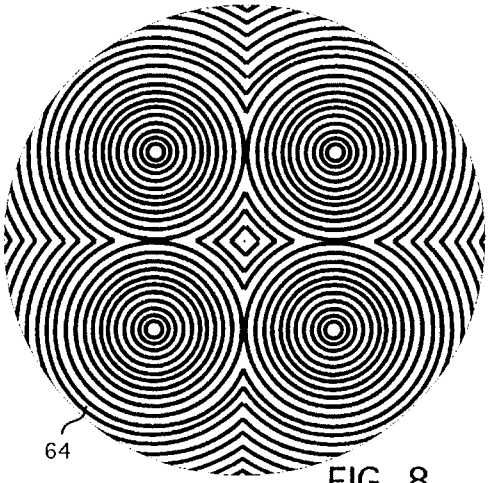
FIG. 8, shows a curvilinear moiré clock pattern composed of four groups of concentric circles with the center of each of the smallest circles being equidistant from each other.
Figure 9:
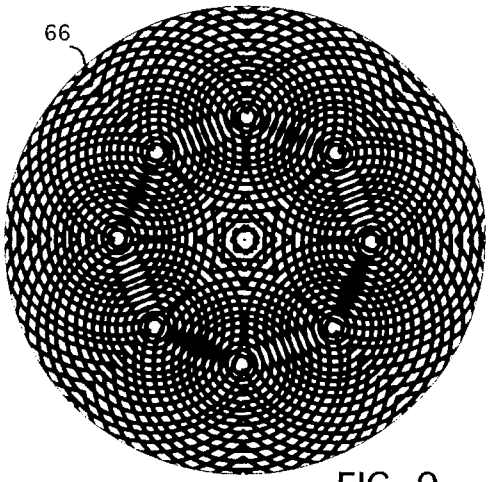
FIG. 9, shows the pattern as seen in FIG. 8 combined with itself and rotated out of alignment to form a composite image.

When certain curvilinear and some linear designs consisting of repeated concentric shapes that are arranged equidistantly away from each other and the center rotational axes, are transparently combined and rotated, a separate composite shape is formed. This can be seen in FIG. 8 which shows a concentric circle pattern 64 which is composed of four groups of concentric circles with the center of each of the smallest circles being equidistant from each other and the rotational center. When pattern 64 is combined with itself and rotated, as can be seen in FIG. 9, forming a composite image 66, a composite separate shape of a large ring is produced.

Very specific and highly controlled animation effects can be created by using designs consisting of concentric rings that are divided into segments and filling each segment with selected patterns. Experiments have shown that each concentric ring can have a different effect and periodicity. Virtually any type of fill pattern can be used in the segments, such as dots, or some other small component. However, it has been found that a linear fill pattern provides for precise control of a variety of animation effects. By choosing the number of segments for a concentric ring, selecting a specific segment of this ring, choosing the angle of the lines to fill this segment from a selection of 0° to 360° and coordinating this segment with the angle of rotation as it relates to the other segments that it will overlay, the type of animation and it's periodicity for a given ring can be determined.

Figure 10:
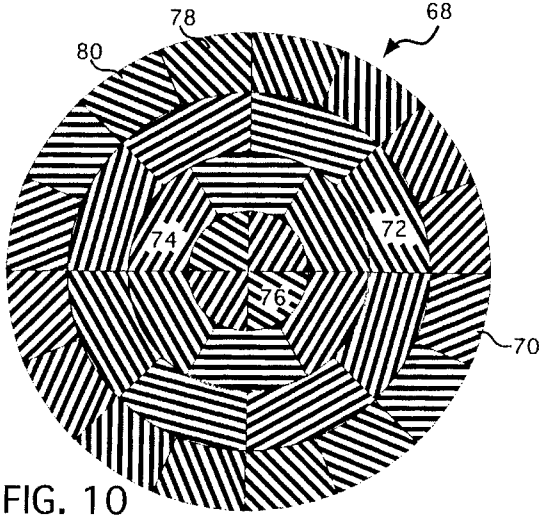
FIG. 10, shows a rectilinear moiré clock pattern composed of four concentric rings, with each ring divided into segments and each segment containing an angled line pattern.
Figure 12:
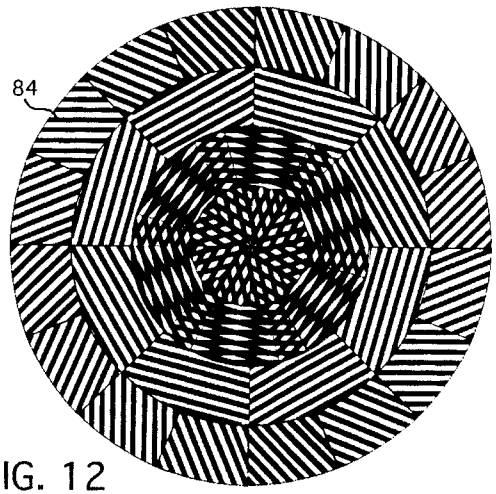
FIG. 12, shows the pattern as seen in FIG. 10 combined with itself and rotated 45° out of alignment to form a composite image.
Figure 14:
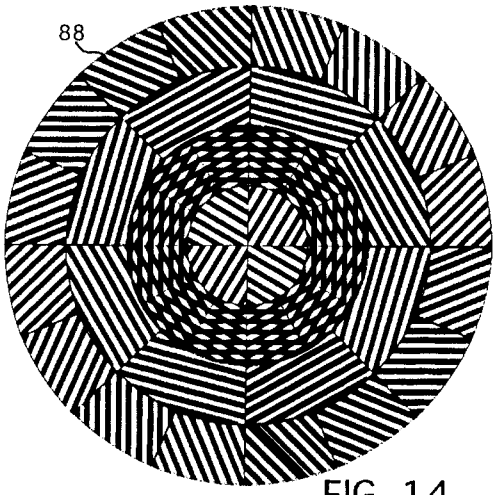
FIG. 14, shows the pattern as seen in FIG. 10 combined with itself and rotated 90° out of alignment to form a composite image.
Figure 11:
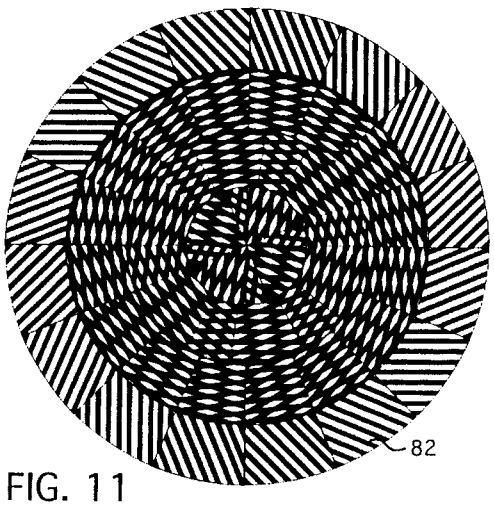
FIG. 11, shows the pattern as seen in FIG. 10 combined with itself and rotated 22.5° out of alignment to form a composite image.
Figure 13:
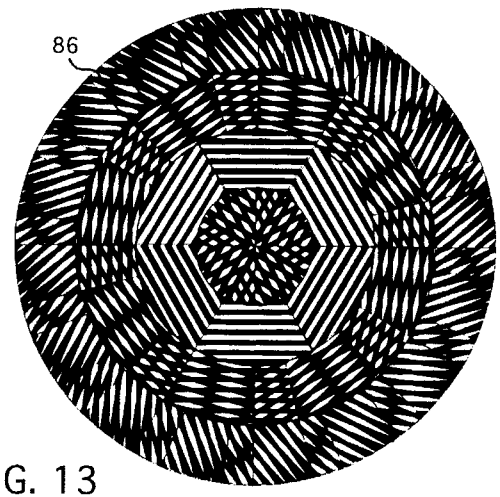
FIG. 13, shows the pattern as seen in FIG. 10 combined with itself and rotated 60° out of alignment to form a composite image.
Figure 15:
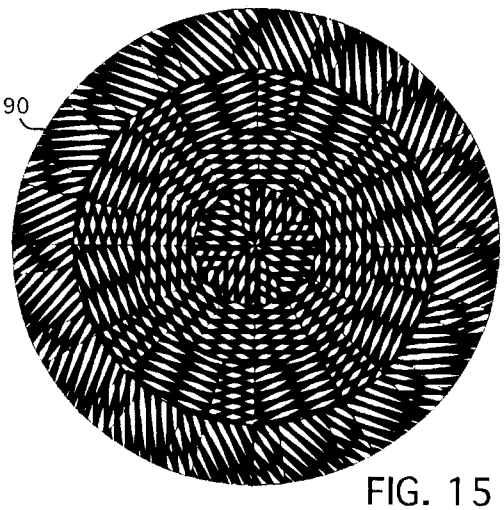
FIG. 15, shows the pattern as seen in FIG. 10 combined with itself and rotated 30° out of alignment to form a composite image.

Experiments have shown that specific animation images for linear moiré designs can be achieved by sequentially alternating a series of angular linear shapes in the following manner:

$360°/N=Y$ and $L+Y=X$, where N represents a radial group of segments, in other words, the desired number of concentric ring segments, which may be any integer, Y represents the resulting rotation angle, L represents the selected initial angled line pattern that may be any angle from 0° to 360° and X represents a rotated angled line pattern for a contiguous segment, this contiguous segment is located counter-clockwise contiguously to the selected segment. The rotation angle Y is subsequently added to the rotated angled line pattern X and then sequentially to all the remaining contiguous counter-clockwise line angle patterns. For example, a concentric ring divided into 16 equal segments will require a rotational angle of 22.5°. FIG. 10 shows a design 68 that is composed of four concentric rings. An outer ring 70 is shown divided into 16 equal segments. An upper segment 78 of ring 70 is initially selected and shown filled with a line group composed of 45° angle equidistant lines. This angled line selection requires a counter-clockwise contiguous segment 80 to be filled with a line group composed of 67.5° angle equidistant lines. The next counter-clockwise contiguous segment therefore must be filled with a line group composed of 90° angle equidistant lines, since 22.5 added to 67.5 equals 90. This process of adding 22.5 to each angle group repeats until all segments of ring 70 are filled. When design 68 is transparently combined with itself and rotated out of alignment 22.5° as shown in FIG. 11, a composite pattern 82 is formed which shows cancellation patterns in every ring except the outer ring, 70. Every 22.5° and multiples of 22.5° rotations of the design will realign outer ring 70, and all other degrees of rotation will create interference patterns in outer ring 70. By selecting 45° angle lines and the location for segment 78, a contrasting, flashy effect is produced. This is due to the more radial nature of this angle as it relates to the segment location. If segment 78 had been filled with horizontal lines, a more sedate animation effect would have been created for outer ring 70. Referring again to FIG. 10, an inner ring 72 is divided into eight segments, therefore requiring a rotational angle of 45°. When combined with itself and rotated 45° as shown in FIG. 12, a composite 84 is formed which shows cancellation patterns in all rings except rings 70 and 72, in other words, since 45° is a multiple of 22.5°, both rings are aligned. FIG. 13 shows a composite pattern 86 in which design 68 is combined with itself and rotated 60°, a six segmented ring 74 shown in alignment. FIG. 14 shows a composite design 88 formed when design 68 is rotated 90° and combined with itself, a four segment center ring 76 shown in alignment. FIG. 15 shows the composite design 90 created when design 68 is combined with itself and rotated 30°, showing that all rings are out of alignment and causing interference patterns in the entire image.

The quantity and width of the concentric rings, like the number of segments and the initial line fill segments are determined by aesthetic choice. The equations may also be used to design asymmetrical animation or other effects. For example, a design containing words, pictures or advertising slogans composed of angled line groups can be calculated to come into alignment and therefore visible at specific rotational periods. This written message effect can be used in conjunction with a standard clock alarm for verbal reminders at specific times. In a different example, specific locations of a composite design can be calculated to sequentially flash on and off at specific periods, producing animation effects such as a single shape chasing itself around the design in different directions. Using these equations also allows for each superposed pattern plate to have a different design. This is due to the ability to calculate the position and transformation of any line group over any portion of a rotation cycle. Using superposed pattern plates with multiple designs permits many possible permutations of animation effects.

It has been found in linear moiré pattern design that line thickness and spacing between lines should be equal, this enhances the cancellation effect during rotation, as well as allowing light to be more easily reflected or transmitted.

Figure 16:
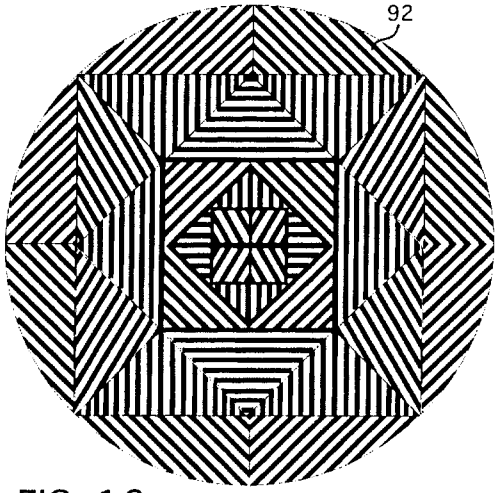
FIG. 16, shows a rectilinear moiré clock pattern composed of alternately concentric squares. The concentric squares are divided into segments and each segment contains an angled line pattern or group of line patterns.
Figure 17:
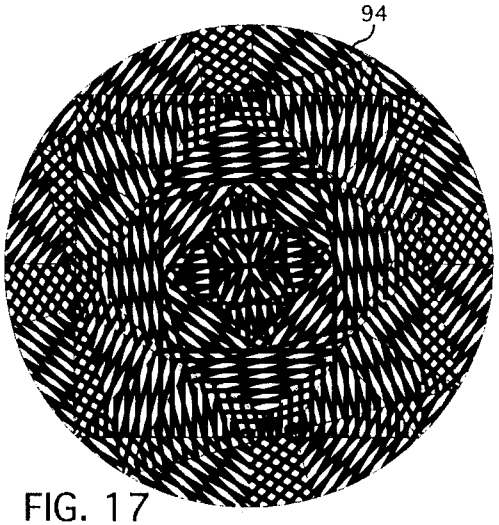
FIG. 17, shows the pattern as seen in FIG. 16 combined with itself and rotated 15° out of alignment to form a composite image.

It should be noted that as a general rule of moiré pattern design, pattern symmetry is proportional to effect repetition. While designs that are divided into figurative shapes or abstract shapes and filled with moiré patterns will produce complex images, a lack of repetition can be uninteresting. Designs that are divided into various geometric segments and filled with moiré patterns, create a variety of images with minor repetition. FIG. 16 shows a design composed of alternately inverted concentric squares 92, with the squares also divided into segments and the segments filled with angled line patterns. FIG. 17 shows the design as seen in FIG. 16 transparently combined with itself and rotated 15° out of alignment to form a composite image 94.

Figure 18:
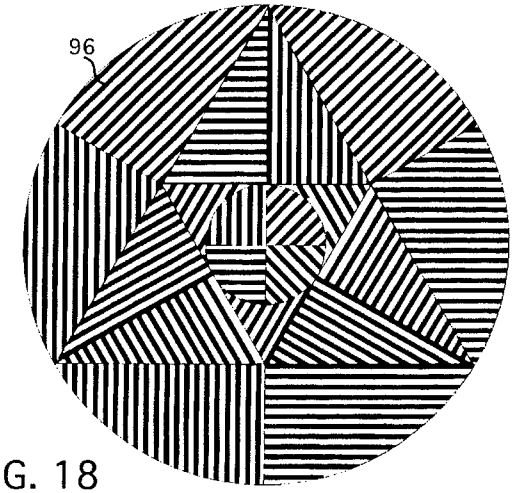
FIG. 18, shows a rectilinear moiré clock pattern primarily composed of two alternately concentric triangles. The concentric triangles are divided into segments and each segment contains an angled line pattern or group of line patterns.
Figure 19:
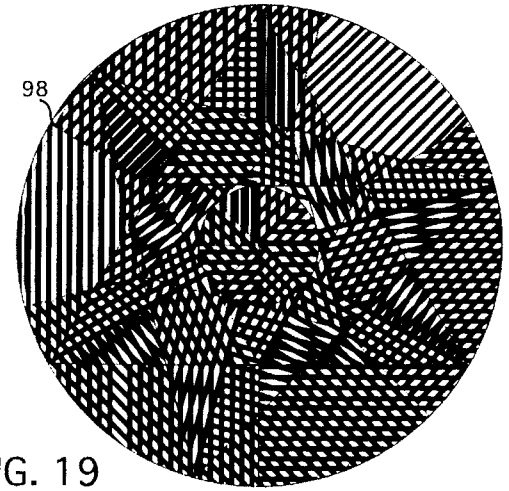
FIG. 19, shows the pattern as seen in FIG. 18 combined with itself and rotated 45° out of alignment to form a composite image.

FIG. 18 shows another example using a different geometric shape, a pattern composed of two concentric triangles that are rotated 90° around their centers to each other as they converge 96. The concentric triangles are divided into segments and each segment contains an angled line pattern or group of line patterns. FIG. 19 shows the design as seen in FIG. 18 combined with itself and rotated 45° out of alignment to form a composite image 98. This design produces a variety of complex animation effects with minimum repetition.

Figure 20:
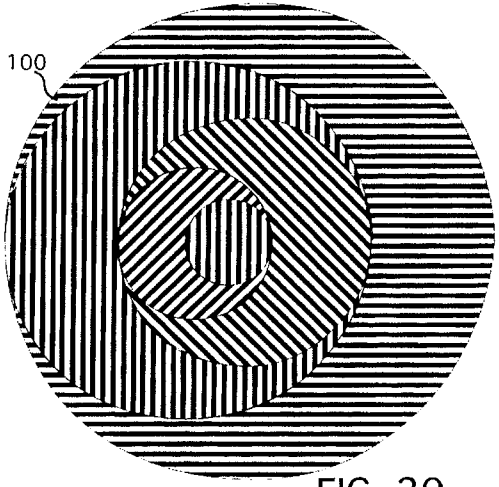
FIG. 20, shows a combination curvilinear and rectilinear moiré clock pattern composed of five circles that are equally offset from each other and are filled with an angled line pattern.
Figure 21:
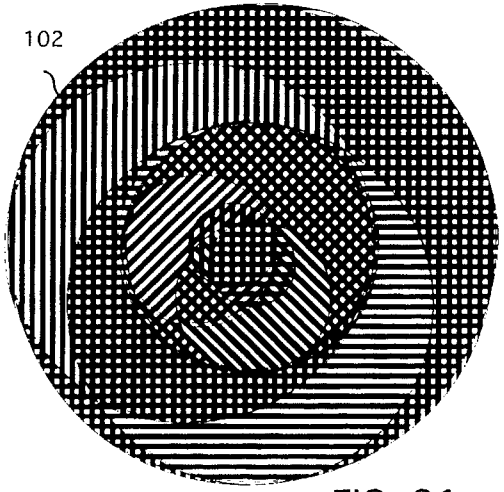
FIG. 21, shows the pattern as seen in FIG. 20 combined with itself and rotated 90° out of alignment to form a composite image.

Even simple geometric shapes like circles and ellipses can produce complex effects when located away from the center of rotation. FIG. 20 shows a design composed of five circles that are equally offset from each other, displaced from the rotational center and are filled with various angled line patterns 100. FIG. 21 shows the design as seen in FIG. 20 combined with itself and rotated 90° out of alignment to form a composite image 102. This design produces a variety of complex, yet graceful animation effects.

For economy of production, it is preferable that all the moiré pattern plates be manufactured from the same material. While almost any thin, flat, transparent or light transmitting material may be used, even perforated sheet material, it has been found that clear polycarbonate film has suitable properties. Some of these properties include: the ability to be easily die cut, ease of screen printing, suitable rigidity and its optical clarity.

Referring again to the drawings, FIGS. 1 and 2 show plates 12, 14, and 16 that are printed with patterns of open and opaque areas. While virtually any color combination of sufficient contrast, including black and white, may be used for the opaque areas of a moiré pattern design, experiments have shown that primary or complimentary colors are highly effective. This is due in part to the inherent contrast of these combinations. To achieve an effective moiré animation, each plate should have a contrasting color, for example plate 16 may have a red pattern, plate 14 a green pattern, and plate 12 a blue pattern. Other colors or color gradients may of course be used for more subtle effects. It is also possible to have segments of each pattern be colored similarly or dissimilarly from each other. If rear illumination is not used, it is preferable that plate 16 have a white or otherwise light reflective background underneath the moiré pattern. This background will increase pattern visibility in ambient lighting. Printed color has been given only as an example, other forms of opaque or non-open areas may be used. For example, patterns made with diffraction gratings or holographic images will produce stimulating effects. It is also possible to use patterns made with temperature sensitive liquid crystals, so that time and temperature may be determined in a single glance, or in the case of a watch, the wearers external temperature.

It is preferable when printing the moiré patterns for use with rear illumination, that the color should not be completely opaque. Somewhat translucent pigments will act as color filters when rear illuminated, creating an effect similar to that of stained glass. Application of the color moiré pattern onto the plates is typically accomplished by any standard printing technique such as, silk screening, or photolithography.

There are many possible techniques to indicate time with this invention, utilizing either the pattern design, or the shape of the plate or a combination, including, but not limited to, a time indicator as an integral part of the moir é pattern design, such as a radial line or negative space, or a pattern segment of a contrasting color or shape, as well as the pattern plate having a protrusion or point. The latter is preferred because internal pattern indicators tend to defeat the moiré animation effects. Therefore time indicators are most effectively located at the perimeter of the patterns using the standard clock indicator conventions. For clarity of temporal recognition, the standard proportional hand widths are most effective. As shown in FIGS. 1 and 2, minute's plate 14 has a minute's indicator point 20 that is narrow and long and hour plate 16 has an hour indicator point 22 that is wider and shorter. These indicator points refer to a group of numerical or graphic time reference numbers 42 on background plate 18. Numbers are provided merely as illustration, other graphical symbols or any abstract shapes may be used. Second's plate 12 does not have an indicator point because this tends to defeat the animation illusion by allowing the viewer to easily track the rotational movement. But in situations where the measuring of seconds is important, a second's indicator point could be provided.

The speed of the animation is dependent on the combined speed of rotation of all pattern plates. For example, with all three pattern plates attached, as shown in FIGS. 1–3, the animation effects are very perceptible, since a complete cycle occurs every sixty seconds. However, if second's plate 12 is omitted, the animation effects are barely perceptible. It is roughly equivalent to watching clouds change shape on a fairly still afternoon.

Should rear illumination of the pattern plates be desired, this can be achieved by conventional internal clock lighting techniques. As shown in FIGS. 2 and 3, a circular fluorescent lamp 38 is mounted inside housing 34 behind graphics plate 18, which is transparent or preferably translucent in the area that is covered by the pattern plates. This allows for uniform rear illumination of the pattern design. A lamp power supply 40 provides the necessary energy to illuminate lamp 38. In the embodiment of a watch, rear illumination is achieved with conventional watch illumination, such as light emitting diodes or electroluminescent panels.

Illumination can also be achieved by printing the pattern with fluorescent inks, and using an ultraviolet light source in front or on the side of the pattern plates. This causes the patterns to become intensely reflective, almost as if they were a neon light source. Rear illumination can also be provided by an electroluminescent panel located behind the pattern plates, or the plates themselves could be electroluminescent panels that are printed with moiré patterns.

If rear illumination is not used with a three plate embodiment, the open areas of the patterns must be large enough and/or of sufficient quantity to transmit and reflect enough ambient light to be clearly visible, this is especially true if there is considerable plate separation. In general, it is preferable that the distance between each pattern plate be kept to a minimum to enhance the visual effect and to prevent parallax distortion. Because of the minimum amount of plate separation in a watch embodiment, moiré animation effects are greatly enhanced, with or without additional illumination.

Although the timepiece has been shown in a standard circular form, other forms for the device may be used, including square, triangular or some other shape. The pattern plates have also been illustrated in the form of circular discs but may also be of any geometric or organic shape.

Although the description above contains many specificity's, this should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A timepiece for producing moiré images corresponding to the passage of time, comprising:

(a) a plurality of plates arranged in generally planar layers;

(b) each of said plurality of plates containing a pattern composed of a group of substantially optically clear areas and a group of substantially optically opaque areas, said patterns of said plurality of plates optically combining to produce multiple moiré images;

(c) rotational means for rotating said plurality of plates at clock speeds, whereby said moiré image is constantly transforming;

(d) at least two of said plurality of plates including different shaped time indicating means for communicating the time; and (e) wherein said patterns consist primarily of a series of angular linear shapes, said linear shapes having an alternating sequence of approximately $360°/N=Y$ and $L+Y=X$, where N is any integer for dividing said plate into a radial group of segments, Y is a rotation angle, L is any angle for said linear shapes for a selected segment from said radial group of segments, said linear shapes composed of substantially equidistant parallel lines and X is a rotated linear shape for a contiguous segment, said contiguous segment located counter-clockwise contiguously to said selected segment, said rotation angle Y being subsequently added to said rotated linear shape X and sequentially to all remaining contiguous counter-clockwise linear shapes of said radial group of segments, whereby the angular difference between each contiguous said linear shape of said radial group of segments is said rotation angle Y.

2. The timepiece of claim 1 wherein said time indicating means comprises a shape for indicating hours and a different shape for indicating minutes.

3. The timepiece of claim 1 further including a stationary background plate having a time reference indicia.

4. The timepiece of claim 1 further including illumination means for radiating light through said plurality of plates, whereby said moiré images are enhanced.

5. The timepiece of claim 2 wherein said time indicating means comprises a shape for indicating hours and a different shape for indicating minutes.

6. The timepiece of claim 2 further including a stationary background plate having a time reference indicia.

7. The timepiece of claim 2 further including illumination means for radiating light through said plurality of plates, whereby said moiré images are enhanced.

8. The timepiece of claim 3 further including illumination means for radiating light through said plurality of plates, whereby said moiré images are enhanced.

9. The timepiece of claim 4 further including illumination means for radiating light through said plurality of plates, whereby said moiré images are enhanced.

10. The timepiece of claim 5 wherein said illumination means for radiating light through said plurality of plates, comprises a fluorescent lamp.

11. The timepiece of claim 5 wherein said illumination means for radiating light through said plurality of plates, comprises an electroluminescent panel.

* * * * *